US009387867B2

(12) United States Patent
Ignatius et al.

(10) Patent No.: US 9,387,867 B2
(45) Date of Patent: Jul. 12, 2016

(54) FUSION SENSOR ARRANGEMENT FOR GUIDEWAY MOUNTED VEHICLE AND METHOD OF USING THE SAME

(71) Applicant: Thales Canada Inc, Toronto, Ontario (CA)

(72) Inventors: Rodney Ignatius, Markham (CA); Alon Green, Toronto (CA); Firth Whitwam, Toronto (CA)

(73) Assignee: Thales Canada Inc, Toronto, Ontario (CA)

( * ) Notice: Subject to any disclaimer, the term of this patent is extended or adjusted under 35 U.S.C. 154(b) by 169 days.

(21) Appl. No.: 14/134,179

(22) Filed: Dec. 19, 2013

(65) Prior Publication Data

US 2015/0175178 A1 Jun. 25, 2015

(51) Int. Cl.

| | |
|---|---|
| ***B61L 23/00*** | (2006.01) |
| ***B61L 23/04*** | (2006.01) |
| ***B61L 15/00*** | (2006.01) |

(52) U.S. Cl.

CPC ..... *B61L 23/041* (2013.01); *B61L 15/0063* (2013.01)

(58) Field of Classification Search

CPC ... B61L 25/026; B61L 25/023; B61L 25/028; B61L 25/021; B61L 25/00; B61L 25/02; B61L 25/025; B61L 25/041; B61L 25/043; B61L 25/06; B61L 25/065

See application file for complete search history.

(56) References Cited

U.S. PATENT DOCUMENTS

| | | | | | |
|---|---|---|---|---|---|
| 3,365,572 | A | * | 1/1968 | Strauss | B61L 23/34 246/167 D |
| 5,893,043 | A | * | 4/1999 | Moehlenbrink | B61L 3/004 246/182 C |
| 6,011,508 | A | * | 1/2000 | Perreault | B61L 3/225 246/122 R |
| 6,163,755 | A | * | 12/2000 | Peer | B61L 23/041 340/436 |

(Continued)

FOREIGN PATENT DOCUMENTS

| | | |
|---|---|---|
| CH | 693308 | 5/2003 |
| CN | 202186403 | 4/2012 |

(Continued)

OTHER PUBLICATIONS

A. Mirabadi et al.,"Fault detection and Isolation in Multisensor Train Navigation Systems", UKACC International Conference on Control '98, Sep. 1-4, 1998, Conference Publication No. 455, IEE, 1998, pp. 185-192.

(Continued)

*Primary Examiner* — Jason C Smith

(74) *Attorney, Agent, or Firm* — Hauptman Ham, LLP

(57) ABSTRACT

A fusion sensor arrangement includes a first sensor configured to detect the presence of an object along a wayside of a guideway, wherein the first sensor is sensitive to a first electromagnetic spectrum. The fusion sensor arrangement further includes a second sensor configured to detect the presence of the object along the wayside of the guideway, wherein the second sensor is sensitive to a second electromagnetic spectrum different from the first electromagnetic spectrum. The fusion sensor arrangement further includes a data fusion center connected to the first sensor and to the second sensor, wherein the data fusion center is configured to receive first sensor information from the first sensor and second sensor information from the second sensor, and to resolve a conflict between the first sensor information and the second sensor information.

20 Claims, 6 Drawing Sheets

(56) References Cited

U.S. PATENT DOCUMENTS

| | | | | |
|---|---|---|---|---|
| 6,402,094 | B1 * | 6/2002 | Beer | B61L 3/225 246/122 R |
| 6,417,765 | B1 * | 7/2002 | Capanna | B61L 23/041 246/166 |
| 2003/0222981 | A1 * | 12/2003 | Kisak | B61L 15/0027 348/148 |
| 2004/0056182 | A1 * | 3/2004 | Jamieson | B61L 23/041 250/221 |
| 2005/0065726 | A1 * | 3/2005 | Meyer | B61L 25/021 701/470 |
| 2005/0161554 | A1 * | 7/2005 | Lotz | B61F 19/06 246/166 |
| 2007/0170315 | A1 * | 7/2007 | Manor | B61F 23/041 246/167 R |
| 2012/0150386 | A1 * | 6/2012 | Armbrust | G01S 7/4026 701/36 |
| 2012/0274772 | A1 * | 11/2012 | Fosburgh | B61K 9/08 348/149 |
| 2013/0060520 | A1 * | 3/2013 | Amor | G01S 5/0018 702/154 |
| 2013/0261837 | A1 * | 10/2013 | Sharma | G08G 1/167 701/1 |
| 2013/0261856 | A1 * | 10/2013 | Sharma | B61L 25/025 701/19 |
| 2014/0054424 | A1 * | 2/2014 | Xu | B61L 23/18 246/122 R |
| 2014/0214247 | A1 * | 7/2014 | Myokei | B61L 15/0063 701/19 |
| 2015/0008293 | A1 * | 1/2015 | Hatazaki | B61L 27/0038 246/30 |
| 2015/0008294 | A1 * | 1/2015 | Desbordes | B61L 25/021 246/122 R |
| 2015/0088345 | A1 * | 3/2015 | Nandedkar | B61L 25/021 701/20 |
| 2015/0120101 | A1 * | 4/2015 | Kimura | B61L 27/0027 701/20 |
| 2015/0134155 | A1 * | 5/2015 | Kanner | G01B 7/125 701/19 |
| 2015/0166085 | A1 * | 6/2015 | Mongaya | B61L 3/00 246/2 S |
| 2015/0175178 | A1 * | 6/2015 | Ignatius | B61L 23/041 246/120 |
| 2015/0239482 | A1 * | 8/2015 | Green | B61L 25/026 246/122 R |

FOREIGN PATENT DOCUMENTS

| | | |
|---|---|---|
| CN | 103192850 | 7/2013 |
| DE | 19746970 | 4/1999 |
| DE | 102010046153 | 3/2012 |
| DE | 102012107918 | 5/2014 |
| EP | 1319751 | 2/2006 |
| EP | 2168839 | 3/2010 |
| EP | 2210791 | 7/2010 |
| WO | 02055362 | 7/2002 |
| WO | 03019233 | 3/2003 |
| WO | 2004028881 | 4/2004 |
| WO | 2006008292 | 1/2006 |
| WO | 2007033939 | 3/2007 |

OTHER PUBLICATIONS

International Search Report for corresponding International PCT Application No. PCT/IB2014/063531, dated Nov. 4, 2014.

Mockel, S. Scherer, et al., "Multi-sensor obstacle detection on railway tracks," Jun. 9, 2003, <http://ieeexplore.ieee.org/xpl/login.jsp?tp=&arnumber=1212880&url=http%3A%2F%2Fieeexplore.ieee.org%2Fxpls%2Fabs_all.jsp%3Farnumber%3D1212880>.

Garcia et al., "Browse Conference Publications >Instrumentation and Measureme . . . ," Instrumentation and Measurement Technology Conference Proceedings, 2008. IMTC 2008. IEEE, May 12, 2008, <http://ieeexplore.ieee.org/xpl/login.jsp?tp=&arnumber=4547393&url=http%3A%2Fieeexplore.ieee.org%2Fxpls%2Fabs_all.jsp%3Farnumber%3D4547393>.

Xianru Liu et al., "Advanced obstacles detection and tracking by fusing millimeter wave radar and image sensor data," Control Automation and Systems (ICCAS), 2010 International Conference, Oct. 27, 2010, <http://ieeexplore.ieee.org/xpl/login.jsp?tp=&arnumber=5669740&url=http%3A%2F%2Fieeexplore.ieee.org%2Fxpls%2Fabs_all.jsp% 3Farnumber%3D5669740>.

* cited by examiner

FUSION SENSOR ARRANGEMENT FOR GUIDEWAY MOUNTED VEHICLE AND METHOD OF USING THE SAME

BACKGROUND

Guideway mounted vehicles include communication train based control (CTBC) systems to receive movement instructions from wayside mounted devices adjacent to a guideway. The CTBC systems are used to determine a location and a speed of the guideway mounted vehicle. The CTBC systems determine the location and speed by interrogating transponders positioned along the guideway. The CTBC systems report the determined location and speed to a centralized control system or a de-centralized control system through the wayside mounted devices.

The centralized or de-centralized control system stores the location and speed information for guideway mounted vehicles within a control zone. Based on this stored location and speed information, the centralized or de-centralized control system generates movement instructions for the guideway mounted vehicles.

When communication between the guideway mounted vehicle and the centralized or de-centralized control system is interrupted, the guideway mounted vehicle is braked to a stop to await a manual driver to control the guideway mounted vehicle. Communication interruption occurs not only when a communication system ceases to function, but also when the communication system transmits incorrect information or when the CTBC rejects an instruction due to incorrect sequencing or corruption of the instruction.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
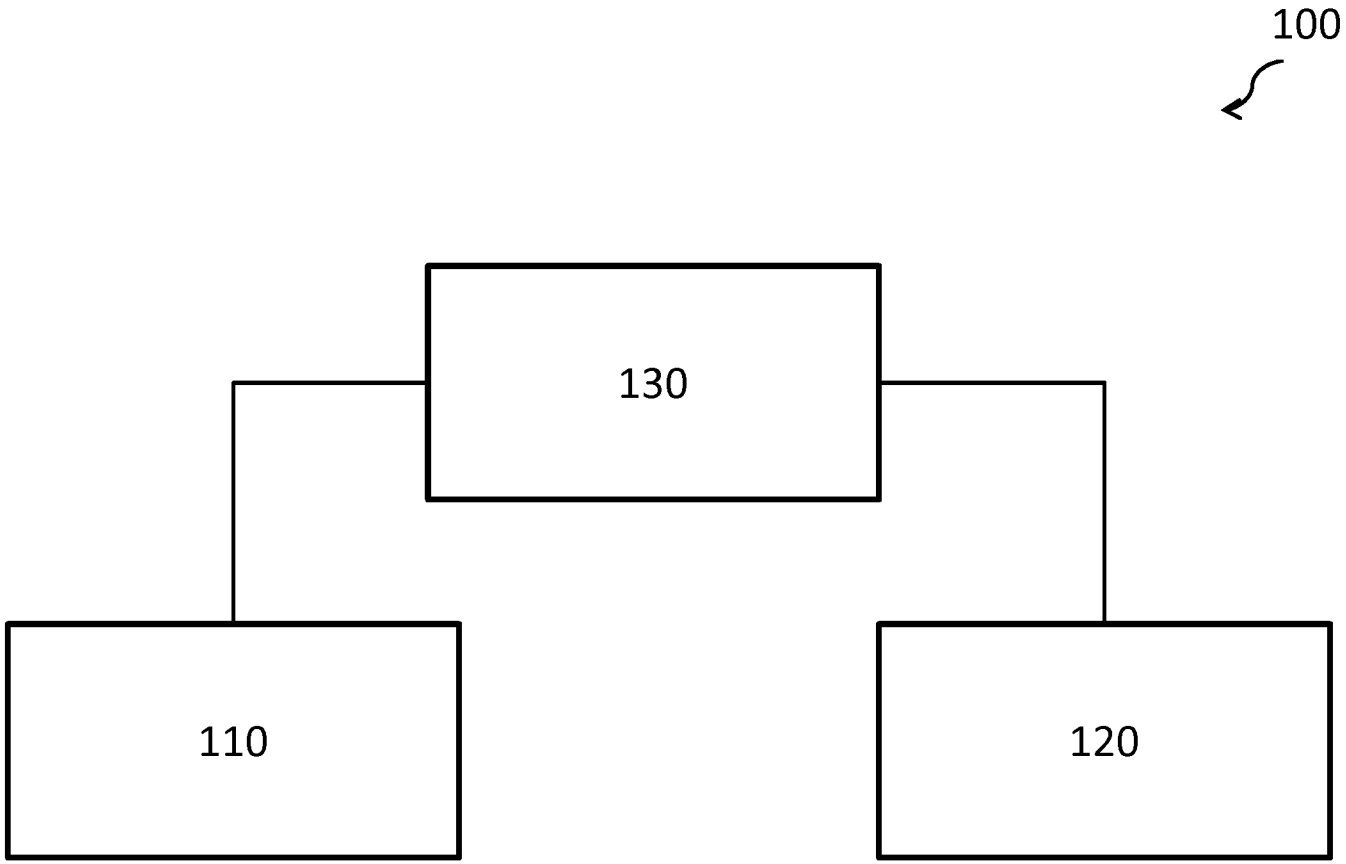
FIG. 1 is a high level diagram of a fusion sensor arrangement in accordance with one or more embodiments.

FIG. 1 is a high level diagram of a fusion sensor arrangement 100 in accordance with one or more embodiments. Fusion sensor arrangement 100 includes a first sensor 110 configured to receive a first type of information. Fusion sensor arrangement 100 further includes a second sensor 120 configured to receive a second type of information different from the first type of information. Fusion sensor arrangement 100 is configured to fuse information received by first sensor 110 with information received by second sensor 120 using a data fusion center 130. Data fusion center 130 is configured to determine whether an object is detected within a detection field of either first sensor 110 or second sensor 120. Data fusion center 130 is also configured to resolve conflicts between first sensor 110 and second sensor 120 arising when one sensor provides a first indication and the other sensor provides a contradictory indication.

In some embodiments, fusion sensor arrangement 100 is integrated with a vital on-board controller (VOBC) configured to generate movement instructions for a guideway mounted vehicle and to communicate with devices external to the guideway mounted vehicle. In some embodiments, fusion sensor arrangement 100 is separate from a VOBC and is configured to provide fused data to the VOBC.

First sensor 110 is configured to be attached to the guideway mounted vehicle. First sensor 110 includes a first detection field which includes an angular range in both a horizontal direction and in a vertical direction. The horizontal direction is perpendicular to a direction of travel of the guideway mounted vehicle and parallel to a top surface of a guideway. The vertical direction is perpendicular to the direction of travel of the guideway mounted vehicle and to the horizontal direction. The angular range in the horizontal direction facilitates detection of objects both along the guideway and along a wayside of the guideway. The angular range in the horizontal direction also increases a line of sight of first sensor 110 in situations where the guideway changes heading. The angular range in the vertical direction increases a line of sight of first sensor 110 in situations where the guideway changes elevation. The angular range in the vertical direction also facilitates detection of overpasses or other height restricting objects.

In some embodiments, first sensor 110 is an optical sensor configured to capture information in a visible spectrum. In some embodiments, first sensor 110 includes a visible light source configured to emit light which is reflected off objects along the guideway or the wayside of the guideway. In some embodiments, the optical sensor includes a photodiode, a charged coupled device (CCD), or another suitable visible light detecting device. The optical sensor is capable of identifying the presence of objects as well as unique identification codes associated with detected objects. In some embodiments, the unique identification codes include barcodes, alphanumeric sequences, pulsed light sequences, color combinations, geometric representations or other suitable identifying indicia.

In some embodiments, first sensor 110 includes a thermal sensor configured to capture information in an infrared spectrum. In some embodiments, first sensor 110 includes an infrared light source configured to emit light which is reflected off objects along the guideway or the wayside of the guideway. In some embodiments, the thermal sensor includes a Dewar sensor, a photodiode, a CCD or another suitable infrared light detecting device. The thermal sensor is capable of identifying the presence of an object as well as unique identifying characteristics of a detected object similar to the optical sensor.

In some embodiments, first sensor 110 includes a RADAR sensor configured to capture information in a microwave spectrum. In some embodiments, first sensor 110 includes a microwave emitter configured to emit electromagnetic radiation which is reflected off objects along the guideway or the wayside of the guideway. The RADAR sensor is capable of identifying the presence of an object as well as unique identifying characteristics of a detected object similar to the optical sensor.

In some embodiments, first sensor 110 includes a laser sensor configured to capture information within a narrow bandwidth. In some embodiments, first sensor 110 includes a laser light source configured to emit light in the narrow bandwidth which is reflected off objects along the guideway or the wayside of the guideway. The laser sensor is capable of identifying the presence of an object as well as unique identifying characteristics of a detected object similar to the optical sensor.

In some embodiments, first sensor 110 includes a radio frequency identification (RFID) reader configured to capture information in a radio wave spectrum. In some embodiments, first sensor 110 includes a radio wave emitter configured to emit an interrogation signal which is reflected by objects on the guideway or on the wayside of the guideway. The RFID reader is capable of identifying the presence of an object as well as unique identifying characteristics of a detected object similar to the optical sensor.

First sensor 110 is configured to identify an object and to track a detected object. Tracking of the detected object helps to avoid reporting false positives because rapid positional changes of the detected object enable a determination that first sensor 110 is not operating properly or that a transitory error occurred within the first sensor.

Second sensor 120 is configured to be attached to the guideway mounted vehicle. Second sensor 120 includes a second detection field which includes an angular range in both a horizontal direction and in a vertical direction. In some embodiments, the second detection field substantially matches the first detection field in order to reduce a risk of conflicts between first sensor 110 and second sensor 120. In some embodiments, the second detection field overlaps with a portion of the first detection field.

In some embodiments, second sensor 120 includes an optical sensor, a thermal sensor, a RADAR sensor, a laser sensor, or an RFID reader. Second sensor 120 is a different type of sensor from first sensor 110. For example, in some embodiments, first sensor 110 is an optical sensor and second sensor 120 is an RFID reader.

Utilizing first sensor 110 and second sensor 120 capable of detecting different types of information, e.g., different electromagnetic spectrums, enables fusion sensor arrangement 100 to reduce a risk of failing to detect an object along the guideway or the wayside of the guideway. Using sensors capable of detecting different types of information also enables confirmation of a detected object. For example, an optical sensor detects a bar code sign located on a wayside of the guideway. In instances where the bar code is defaced by dirt or graffiti such that the optical sensor cannot uniquely identify the bar code sign, an RFID reader may still be able to confirm the identifying information of the bar code sign based on an RF transponder attached to the bar code sign.

First sensor 110 and second sensor 120 are capable of identifying an object without additional equipment such as a guideway map or location and speed information. The ability to operate with out additional equipment decreases operating costs for first sensor 110 and second sensor 120 and reduces points of failure for fusion sensor arrangement 100.

Data fusion center 130 includes a non-transitory computer readable medium configured to store information received from first sensor 110 and second sensor 120. Data fusion center 130 also includes a processor configured to execute instructions for identifying objects detected by first sensor 110 or second sensor 120. The processor of data fusion center 130 is further configured to execute instructions for resolving conflicts between first sensor 110 and second sensor 120.

Data fusion center 130 is configured to receive information from first sensor 110 and second sensor 120 and confirm detection of an object and whether the detected object contains identifying information. Data fusion center 130 is further configured to determine a distance from the fusion sensor arrangement 100 to the detected object, a relative speed of the object, a heading angle of the object and an elevation angle of the object.

Based on these determinations, data fusion center 130 is capable of tracking the detected object as the guideway mounted vehicle travels along the guideway to determine whether the object is on the guideway or on the wayside of the guideway. Tracking the object means that a location and relative speed of the object are regularly determined in a time domain. In some embodiments, the location and relative speed of the object are determined periodically, e.g., having an interval ranging from 1 second to 15 minutes. In some embodiments, the location and relative speed of the object are determined continuously.

Data fusion center 130 is also capable of comparing information from first sensor 110 with information from second sensor 120 and resolving any conflicts between the first sensor and the second sensor. Data fusion center 130 is configured to perform plausibility checks to help determine whether a sensor is detecting an actual object. In some embodiments, the plausibility check is performed by tracking a location of the object. In some embodiments, a relative change in the location of the object with respect to time which exceeds a threshold value results in a determination that the detected object is implausible. When an implausible determination is made, data fusion center 130 considers information received from the other sensor to be more reliable. In some embodiments, data fusion center 130 initiates a status check of a sensor which provides implausible information. In some embodiments, data fusion center initiates a status check of a sensor which provides implausible information multiple times within a predetermined time period.

In some embodiments, when one sensor detects an object but the other sensor does not, data fusion center 130 is configured to determine that the object is present. In some embodiments, data fusion center 130 initiates a status check of the sensor which did not identify the object. In some embodiments, data fusion center 130 initiates a status check of the sensor which did not identify the object based on a type of object detected. For example, a thermal sensor is not expected to identify RFID transponder; therefore, the data fusion center 130 would not initiate a status check of the thermal sensor, in some embodiments.

In some embodiments, when one sensor detects a first type of object and the other sensor detects a second type of object different from the first type of object data fusion center 130 selects the object type based on a set of priority rules. In some embodiments, the priority rules give a higher priority to a certain type of sensor, e.g., a RADAR sensor over a laser sensor. In some embodiments, priority between sensor types is determined based on a distance between fusion sensor arrangement 100 and the detected object. For example, priority is given to the RADAR sensor if the distance between fusion sensor arrangement 100 and the detected object is greater than 100 meters (m) and priority is given to the laser sensor if the distance is less than 100 m or less.

Data fusion center 130 is a vital system. In some embodiments, data fusion center 130 has a safety integrity level 4 (SIL 4). In some embodiments, SIL 4 is based on International Electrotechnical Commission's (IEC) standard IEC 61508, in at least one embodiment. SIL level 4 means the probability of failure per hour ranges from $10^{-8}$ to $10^{-9}$.

Fusion sensor arrangement 100 is able to achieve a low rate of failure through the use of two separate sensor configured to detect objects using diverse detection techniques. In some embodiments, each sensor is designed to have a failure rate of about $3.8\times10^{-5}$ failures per hour, meaning a single failure every three years. A probability of two sensors having a failure at a same time is about $T\times3.6\times10^{-10}$ failures per hour, where T is an expected time interval between detected objects. In some embodiments, T ranges from about 2 minutes to about 40 minutes. In some embodiments, if fusion sensor arrangement 100 fails to detect an object within 2T, the fusion sensor arrangement is determined to be faulty and is timed out.

The above description is based on the use of two sensors, first sensor 110 and second sensor 120, for the sake of clarity. One of ordinary skill in the art would recognize that additional sensors are able to be incorporated into fusion sensor arrangement 100 without departing from the scope of this description. In some embodiments, redundant sensors which are a same sensor type as first sensor 110 or second sensor 120 are included in fusion sensor arrangement 100. In some embodiments, additional sensors of different sensor type from first sensor 110 and second sensor 120 are included in fusion sensor arrangement 100.

Data fusion center 130 is also capable of identifying location determining information such as the unique identification information for the object. Data fusion center 130 is able to provide information regarding whether the guideway mounted vehicle is aligned with an object, e.g., for positioning doors for passenger vehicles with platform openings.

Figure 2A:
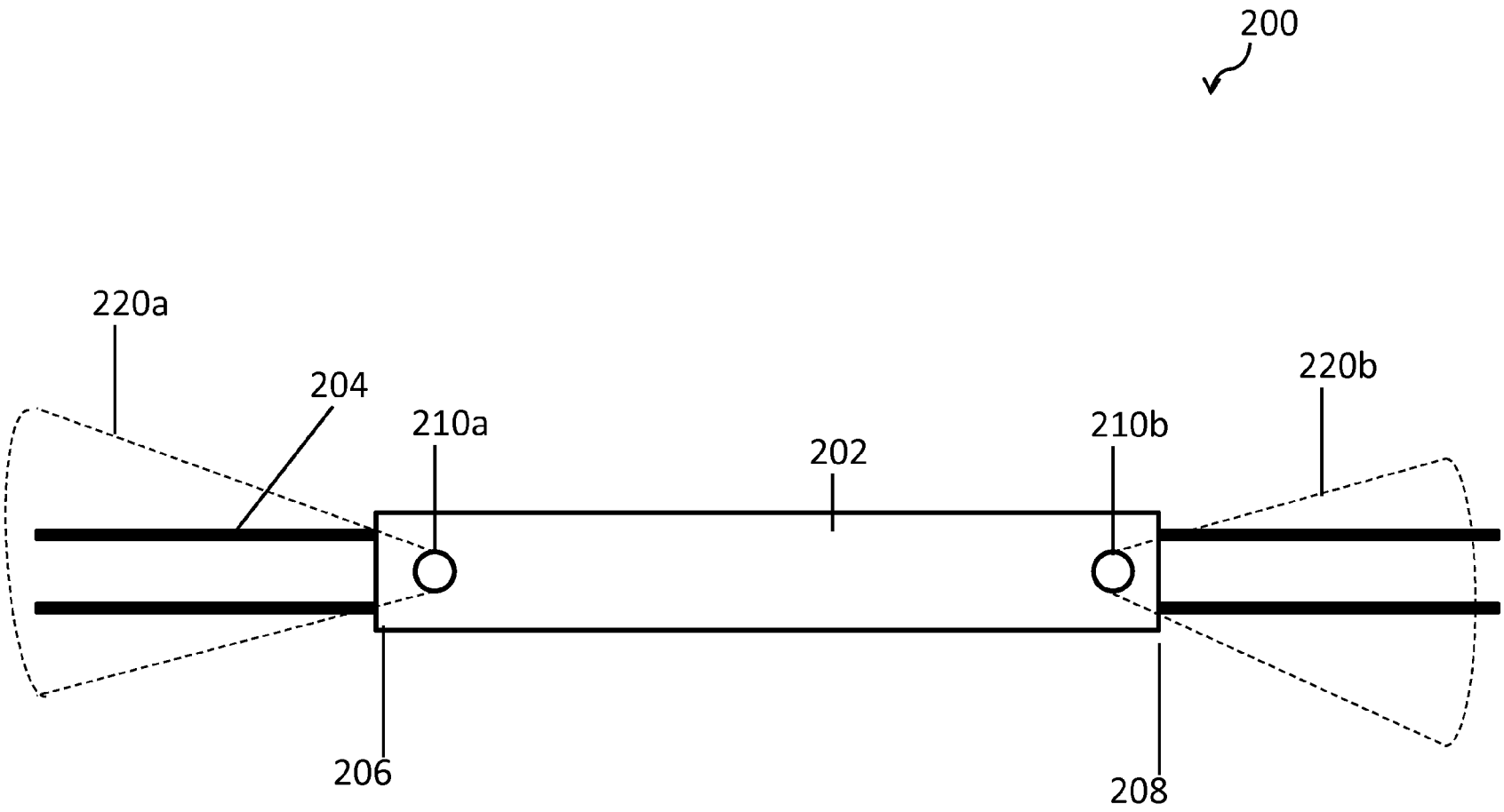
FIG. 2A is a high level diagram of a guideway mounted vehicle including fusion sensor arrangements in accordance with one or more embodiments.

FIG. 2A is a high level diagram of a guideway mounted vehicle 202 including fusion sensor arrangements 210*a* and 210*b* in accordance with one or more embodiments. Guideway mounted vehicle 202 is positioned on a guideway 204. Guideway mounted vehicle 202 has a first end 206 and a second end 208. A first fusion sensor arrangement 210*a* is located at first end 206 and a second fusion sensor arrangement 210*b* is located at second end 208. First fusion sensor arrangement 210*a* has a first field of detection 220*a* extending from first end 206. First field of detection 220*a* extends in an angular range in the horizontal direction and in the vertical direction. Second fusion sensor arrangement 210*b* has a second field of detection 220*b* extending from second end 208. Second field of detection 220*b* extends in an angular range in the horizontal direction and in the vertical direction.

Guideway mounted vehicle 202 is configured to traverse along guideway 204. In some embodiments, guideway mounted vehicle 202 is a passenger train, a cargo train, a tram, a monorail, or another suitable vehicle. In some embodiments, guideway mounted vehicle 202 is configured for bi-directional travel along guideway 204.

Guideway 204 is configured to provide a direction and heading of travel for guideway mounted vehicle 202. In some embodiments, guideway 204 includes two spaced rails. In some embodiments, guideway 204 includes a monorail. In some embodiments, guideway 204 is along a ground. In some embodiments, guideway 204 is elevated above the ground.

First end 206 and second end 208 are a corresponding leading end and trailing end of guideway mounted vehicle 202 depending on a direction of travel of the guideway mounted vehicle. By attaching fusion sensor arrangements 210*a* and 210*b* at both first end 206 and second end 208, either first detection field 220*a* or second detection field 220*b* extend in front of guideway mounted vehicle 202 in the direction of travel.

First fusion sensor arrangement 210*a* and second fusion sensor arrangement 210*b* are similar to fusion sensor arrangement 100 (FIG. 1). In some embodiments, at least one of first fusion sensor arrangement 210*a* or second fusion sensor arrangement 210*b* is integrated with a VOBC on guideway mounted vehicle 202. In some embodiments, both first fusion sensor arrangement 210*a* and second fusion sensor arrangement 210*b* are separate from the VOBC. In some embodiments, at least one of first fusion sensor arrangement 210*a* or second fusion sensor arrangement 210*b* is detachable from guideway mounted vehicle to facilitate repair and replacement of the fusion sensor arrangement.

Figure 2B:
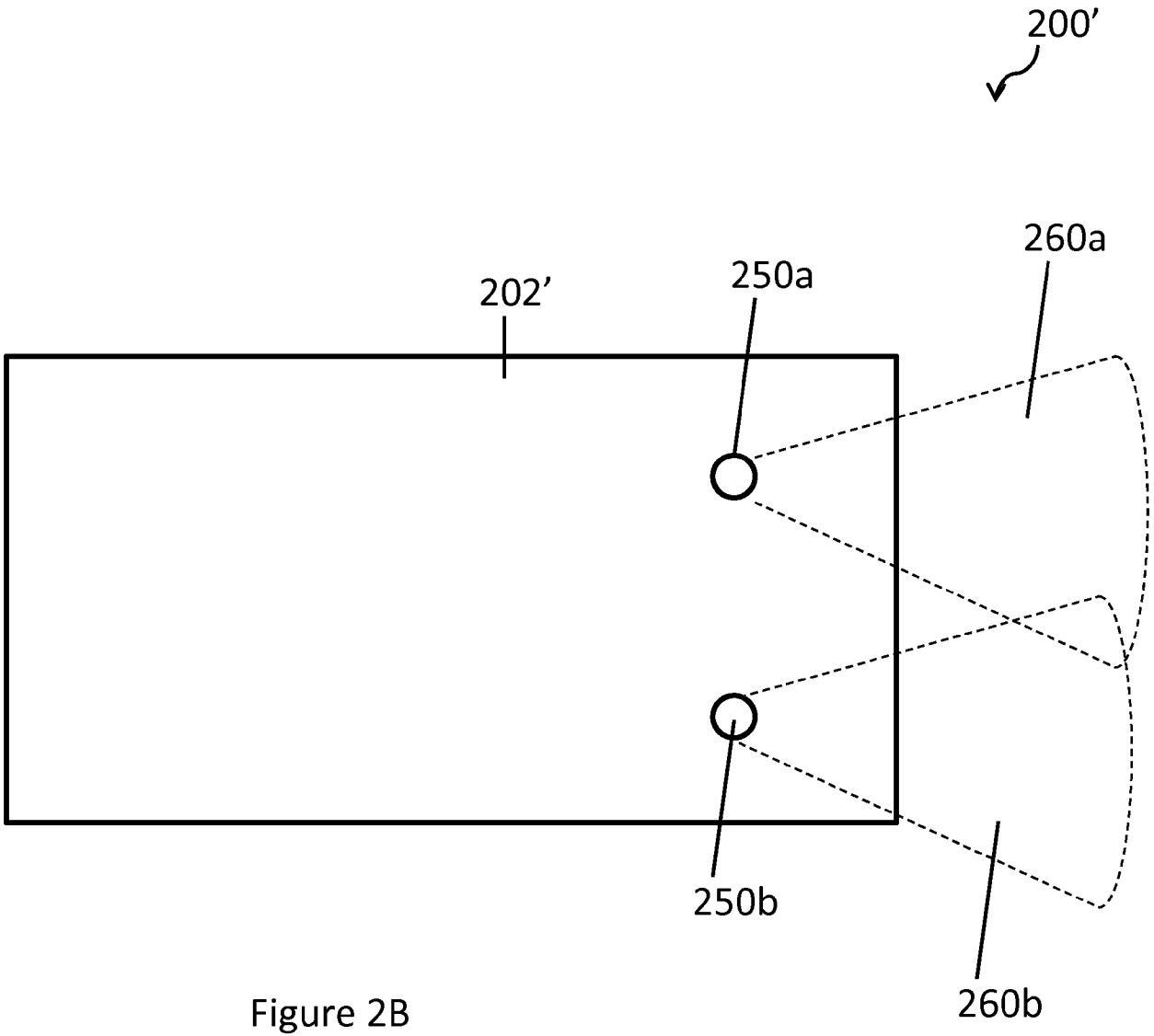
FIG. 2B is a high level diagram of a guideway mounted vehicle including fusion sensor arrangements in accordance with one or more embodiments.

FIG. 2B is a high level diagram of a guideway mounted vehicle 200' including fusion sensor arrangements 250*a* and 250*b* in accordance with one or more embodiments. FIG. 2B includes only a single end of guideway mounted vehicle 200' for simplicity. Guideway mounted vehicle 200' includes a first fusion sensor arrangement 250*a* and a second fusion sensor arrangement 250*b*. First fusion sensor arrangement 250*a* has a first field of detection 260*a*. Second fusion sensor arrangement 250*b* has a second field of detection 260*b*. First field of detection 260*a* overlaps with second field of detection 260*b*.

First fusion sensor arrangement 250*a* and second fusion sensor arrangement 250*b* are similar to fusion sensor arrangement 100 (FIG. 1). In some embodiments, first fusion sensor arrangement 250*a* has a same type of sensors as second fusion sensor arrangement 250*b*. In some embodiments, first fusion sensor arrangement 250*a* has at least one different type of sensor from second fusion sensor arrangement 250*b*. By using multiple fusion sensor arrangements 250*a* and 250*b*, a position of an objection is able to be triangulated by measuring a distance between each fusion sensor arrangement and the object.

Figure 3:
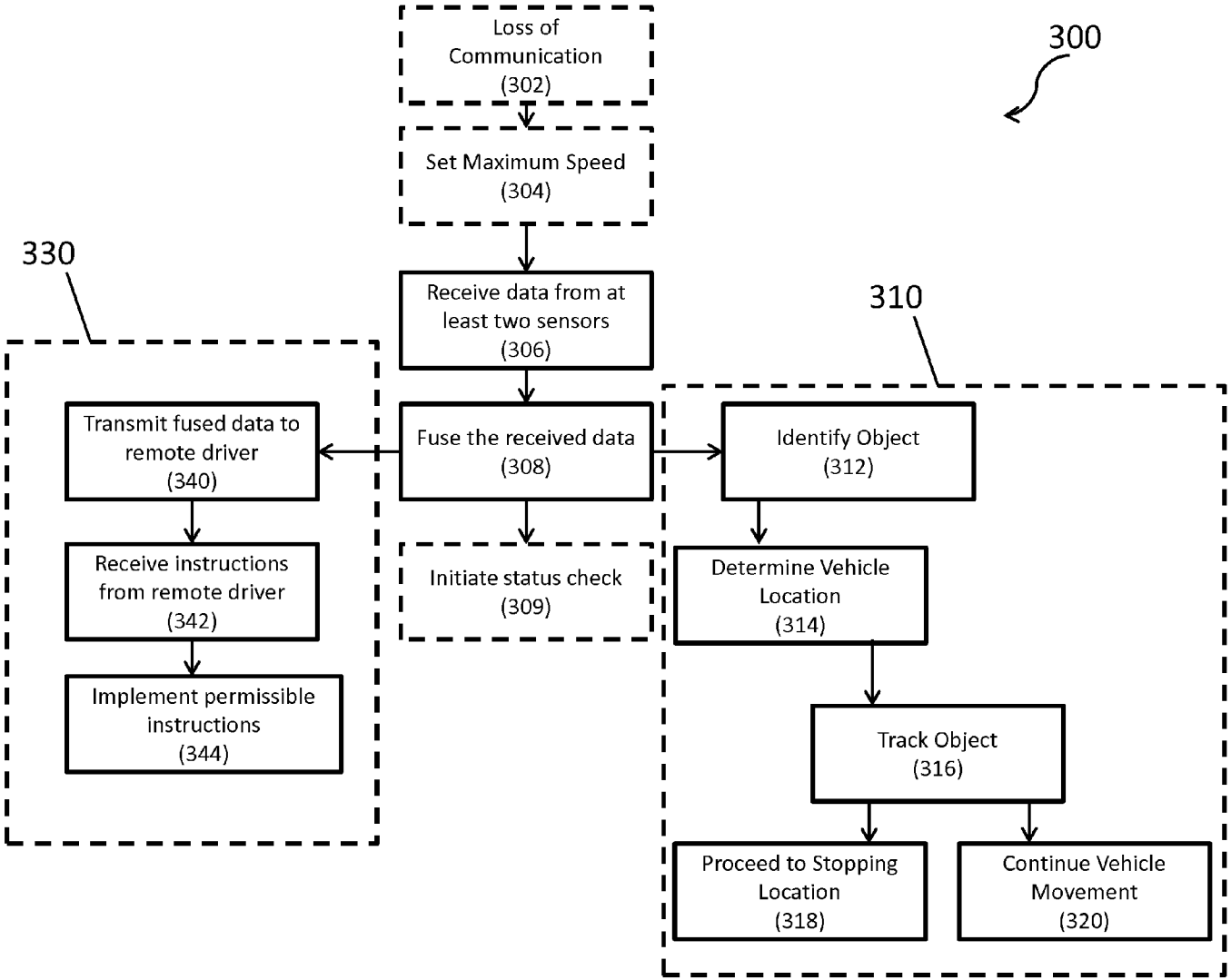
FIG. 3 is a flow chart of a method of controlling a guideway mounted vehicle using a fusion sensor arrangement in accordance with one or more embodiments.

FIG. 3 is a flow chart of a method 300 of controlling a guideway mounted vehicle using a fusion sensor arrangement in accordance with one or more embodiments. The fusion sensor arrangement in method 300 is used in combination with a VOBC. In some embodiments, the fusion sensor arrangement is integrated with the VOBC. In some embodiments, the fusion sensor arrangement is separable from the VOBC. In optional operation 302, the VOBC communication with a centralized or de-centralized control system is lost. In some embodiments, communication is lost due to a device failure. In some embodiments, communication is lost due to signal degradation or corruption. In some embodiments, communication is lost due to blockage of the signal by a terrain. In some embodiments, operation 302 is omitted. Operation 302 is omitted in some embodiments where the fusion sensor arrangement is operated simultaneously with instructions received from centralized or de-centralized communication system.

In some embodiments, information received through the fusion sensor arrangement is transmitted via the VOBC to the centralized or de-centralized communication system. In some embodiments, information received through the fusion sensor arrangement is provided to a remote driver to facilitate control of the guideway mounted vehicle by the remote driver. In some embodiments, the remote driver is able to receive images captured by the fusion sensor arrangement. In some embodiments, the remote driver is able to receive numerical information captured by the fusion sensor arrangement. In some embodiments, the VOBC is configured to receive instructions from the remote driver and automatically control a braking and acceleration system of the guideway mounted vehicle.

In optional operation 304, a maximum speed is set by the VOBC. The maximum speed is set so that the guideway mounted vehicle is capable of braking to a stop within a line of sight distance of the fusion sensor arrangement. In situations where the VOBC relies solely on the fusion sensor arrangement for the detection of objects along the guideway or the wayside of the guideway, such as during loss of communication with the centralized or de-centralized control system, the VOBC is able to determine a limit of movement authority (LMA) to the extent that the fusion sensor arrangement is capable of detecting objects. The VOBC is capable of automatically controlling the braking and acceleration system of the guideway mounted vehicle in order to control the speed of the guideway mounted vehicle to be at or below the maximum speed. In some embodiments, operation 304 is omitted if the VOBC is able to communicate with the centralized or de-centralized control system and is able to receive LMA instructions through the control system. The centralized and de-centralized control systems have information regarding the presence of objects along the guideway within an area of control of the control system. If the area of control extends beyond a line of sight of the fusion sensor arrangement, the VOBC is able to set a speed greater than the maximum speed in order for the guideway mounted vehicle to more efficiently travel along the guideway.

Data is received from at least two sensors in operation 306. The at least two sensors are similar to first sensor 110 or second sensor 120 (FIG. 1). In some embodiments, data is received by more than two sensors. At least one sensor of the at least two sensors is capable of a different type of detection from the at least another sensor of the at least two sensors. For example, one sensor is an optical sensor and the other sensor is an RFID reader. In some embodiments, at least one sensor of the at least two sensors is capable of a same type of detection as at least another sensor of the at least two sensors. For example, a redundant optical sensor is included in case a primary optical sensor fails, in some embodiments.

A field of detection of each sensor of the at least two sensors overlaps with each other. The field of detection includes an angular range in the horizontal direction and an angular range in the vertical direction. The angular range in the horizontal directions enables detection of objects along the guideway and the wayside of the guideway. The angular range in the vertical direction enables detection of objects which present a vertical blockage. The angular range in the vertical direction also enables detection of objects on a guideway above or below the guideway on which the guideway mounted vehicle is located.

In operation 308, the received data is fused together. The received data is fused together using a data fusion center, e.g., data fusion center 130 (FIG. 1). The data is fused together to provide a more comprehensive detection of objects along the guideway and the wayside of the guideway in comparison with data representing a single type of detection. In some embodiments, fusing the data includes confirming detection of an object and whether the detected object contains identifying information. In some embodiments, fusing the data includes determining a relative position, speed or heading of the detected object. In some embodiments, fusing the data together includes resolving conflicts between the received data. In some embodiments, fusing the data includes performing a plausibility check.

Resolving conflicts between the received data results is performed when data received from one sensor does not substantially match with data received by the other sensor. In some embodiments, a predetermine tolerance threshold is established for determining whether a conflict exists within the received data. The predetermined tolerance threshold helps to account for variations in the data which result from the difference in the detection type of the sensors. In some embodiments, a conflict is identified if an object is detected by one sensor but the object is not detected by the other sensor. In some embodiments, a status check of the sensor which did not identify the object is initiated. In some embodiments, a status check of the sensor which did not identify the object is initiated based on a type of object detected. For example, a thermal sensor is not expected to identify RFID transponder; therefore, a status check of the thermal sensor is not initiated, in some embodiments.

In some embodiments, conflicts between the received data related to the detected object are resolved by averaging the data received from the sensors. In some embodiments, resolving the conflict is based on a set of priority rules. In some embodiments, the priority rules give a higher priority to a certain type of sensor, e.g., a RFID reader over an optical sensor. In some embodiments, priority between sensor types is determined based on a distance between the fusion sensor arrangement and the detected object. For example, priority is given to the RADAR sensor if the distance between the fusion sensor arrangement and the detected object is greater than 100 meters (m) and priority is given to the optical sensor if the distance is 100 m or less.

Performing the plausibility check includes evaluating a relative change in the location of the object with respect to time. If the relative change in location exceeds a threshold value the object is determined to be implausible. When an implausible determination is made with respect to one sensor, data received from the other sensor is determined to be more reliable. In some embodiments, a status check of a sensor which provides implausible information is initiated. In some embodiments, a status check of a sensor which provides implausible information multiple times within a predetermined time period is initiated.

In optional operation 309, a status check of at least one sensor is initiated. In some embodiments, the status check is initiated as a result of a conflict between the received data. In some embodiments, the status check is initiated as a result of receiving implausible data. In some embodiments, the status check is initiated periodically to determine a health of a sensor prior to a conflict or receipt of implausible data. In some embodiments, periodic status checks are suspended while communication with the centralized or de-centralized control system is lost unless a conflict or implausible data is received.

In some embodiments, the VOBC receives the fused data and operates in conjunction with the centralized or de-centralized control to operate the guideway mounted vehicle. The VOBC receives LMA instructions from the centralized or de-centralized control. The LMA instructions are based on data collected with respect to objects, including other guideway mounted vehicles, within an area of control for the centralized or de-centralized control system. Based on the received LMA instructions, the VOBC will control the acceleration and braking system of the guideway mounted vehicle in order to move the guideway mounted vehicle along the guideway.

The VOBC receives the fused data from the fusion sensor arrangement and determines a speed and a location of the guideway mounted vehicle based on the detected objects. For example, a sign or post containing a unique identification is usable to determine a location of the guideway mounted vehicle. In some embodiments, the VOBC includes a guideway database which includes a map of the guideway and a location of stationary objects associated with unique identification information. In some embodiments, the VOBC is configured to update the guideway database to include movable objects based on information received from the centralized or de-centralized control system. By comparing the fused data with respect to an identifiable object with the guideway database, the VOBC is able to determine the location of the guideway mounted vehicle. In some embodiments, the VOBC determines a speed of the guideway mounted vehicle based on a change in location of an object detected in the fused data. The VOBC transmits the determined location and speed of the guideway mounted vehicle to the centralized or de-centralized control system.

In some embodiments, if communication with the centralized or de-centralized control system is lost, the VOBC performs autonomous operations 310. In operation 312, the VOBC identifies a detected object based on the fused data. In some embodiments, the VOBC identifies the detected object by comparing the fused data with information stored in the guideway database.

In some embodiments, the VOBC uses the identified object to determine a location of the guideway mounted vehicle in operation 314. In some embodiments, the VOBC determines the location of the guideway mounted vehicle based on unique identification information associated with the detected object. In some embodiments, the VOBC compares the unique identification information with the guideway database to determine the location of the guideway mounted vehicle.

The identified object is tracked in operation 316. Tracking the object means that a location and relative speed of the object are regularly determined in a time domain. In some embodiments, the object is tracked to determine whether the object will be on the guideway at a same location as the guideway mounted vehicle. In some embodiments, the object is tracked in order to provide location information for a non-communicating guideway mounted vehicle. In some embodiments, the location and relative speed of the object are determined periodically, e.g., having an interval ranging from 1 second to 15 minutes. In some embodiments, the location and relative speed of the object are determined continuously.

In operation 318, the VOBC provides instructions for the guideway mounted vehicle to proceed to a stopping location. In some embodiments, the stopping location includes a destination of the guideway mounted vehicle, a switch, a detected object on the guideway, coupling/de-coupling location, a protection area of a non-communicating guideway mounted vehicle or another suitable stopping location. A non-communicating guideway mounted vehicle is a vehicle which is traveling along the guideway which is under only manual operation, is experiencing a communication failure, lacks communication equipment or other similar vehicles. The VOBC autonomously generates instructions including LMA instructions. The LMA instructions are executed based on signals transmitted to the acceleration and braking system. In some embodiments, the LMA instructions are based on the location of the guideway mounted vehicle determined in operation 314 and the guideway database.

In some embodiments where the stopping location is a destination of the guideway mounted vehicle, the LMA instructions generated by the VOBC enable the guideway mounted vehicle to travel to a platform, station, depot or other location where the guideway mounted vehicle is intended to stop. In some embodiments, the VOBC controls the acceleration and braking system to maintain the guideway mounted vehicle at the destination until communication is re-established with the centralized or de-centralized control system or until a driver arrives to manually operate the guideway mounted vehicle.

In some embodiments where the stopping location is a switch, the LMA instructions generated by the VOBC cause the guideway mounted vehicle to stop at a heel of the switch if the switch is in a disturbed state. In some embodiments, the LMA instructions cause the guideway mounted vehicle to stop if the fused data fails to identify a state of the switch. In some embodiments, the LMA instructions cause the guideway mounted vehicle to stop if the fused data indicates a conflict regarding a state of the switch. In some embodiments, the LMA instructions cause the guideway mounted vehicle to stop if the most recent information received from the centralized or de-centralized control system indicated the switch is reserved for another guideway mounted vehicle.

In some embodiments where the stopping location is an object detected on the guideway, the LMA instructions generated by the VOBC cause the guideway mounted vehicle to stop a predetermined distance prior to reaching the detected object. In some embodiments, the object is a person, a disturbed switch, debris or another object along the guideway. In some embodiments, the VOBC uses the fused data to predict whether a detected object will be on the guideway when the guideway mounted vehicle reaches the location of the object. In some embodiments, the LMA instructions cause the guideway mounted vehicle to stop the predetermined distance prior to the object if the object is predicted to be on the guideway at the time the guideway mounted vehicle reaches the location of the object.

In some embodiments where the stopping location is a coupling/uncoupling location, the LMA instructions generated by the VOBC cause the guideway mounted vehicle to stop at the coupling/de-coupling location. The fused data is used to determine a distance between the guideway mounted vehicle and the other vehicle to be coupled/de-coupled. The VOBC is used to control the speed of the guideway mounted vehicle such that the coupling/de-coupling is achieved without undue force on a coupling joint of the guideway mounted vehicle. In some embodiments, the VOBC brings the guideway mounted vehicle to a stop while a separation distance between the two guideway mounted vehicles is less than a predetermined distance.

In some embodiments, where the stopping location is the protection area of a non-communicating guideway mounted vehicle, the LMA instructions generated by the VOBC stop the guideway mounted vehicle prior to entering the protection area. The protection area is a zone around the non-communicating guideway mounted vehicle to enable movement of the non-communicating guideway mounted vehicle with minimal interference with other guideway mounted vehicles. The protection area is defined by the centralized or de-centralized control system. In some embodiments, the LMA instructions cause the guideway mounted vehicle to stop prior to entering the protection area based on the most recent received information from the centralized or de-centralized control system.

One of ordinary skill in the art would recognize that additional stopping location and control processes are within the scope of this description.

In some embodiments, the VOBC continues movement of the guideway mounted vehicle along the guideway, in operation 320. The continued movement is based on a lack of a stopping location. In some embodiments, the VOBC controls reduction of the speed of the guideway mounted vehicle if a switch is traversed. The reduced speed is a switch traversal speed. The switch traversal speed is less than the maximum speed from operation 304. In some embodiments, operation 320 is continued until a stopping location is reached, communication is re-established with the centralized or de-centralized control system or a manual operator arrives to control the guideway mounted vehicle.

In some embodiments, following fusing of the received data in operation 308, LMA instructions are generated using remote driver operations 330. In operation 340, the fused data is transmitted to the remote driver, i.e., an operator who is not on-board the guideway mounted vehicle. In some embodiments, fused data is transmitted using the centralized or de-centralized control system. In some embodiments, the fused data is transmitted using a back-up communication system such as an inductive loop communication system, a radio communication system, a microwave communication system, or another suitable communication system. In some embodiments, the fused data is transmitted as an image. In some embodiments, the fused data is transmitted as alphanumerical information. In some embodiments, the fused data is transmitted in an encrypted format.

In operation 342, the VOBC receives instructions from the remote driver. In some embodiments, the VOBC receives instructions along a same communication system used to transmit the fused data. In some embodiments, the VOBC receives the instructions along a different communication system from that used to transmit the fused data. In some embodiments, the instructions include LMA instructions, speed instructions, instructions to traverse a switch, or other suitable instructions.

The VOBC implements permissible instructions in operation 344. In some embodiments, permissible instructions are instructions which do not conflict with the maximum speed set in operation 304, a switch traversal speed, traversing a disturbed switch, traversing a portion of the guideway where an object is detected or other suitable conflicts. In some embodiments, if the speed instructions from the remote driver exceed the maximum speed, the VOBC controls the guideway mounted vehicle to travel at the maximum speed. In some embodiments, if the speed instructions from the remote driver exceed the switch traversal speed, the VOBC controls the guideway mounted vehicle to travel at the switch traversal speed. In some embodiments, the VOBC controls the guideway mounted vehicle to traverse a switch which the fused data indicates as disturbed (or a conflict exists regarding the state of the switch) if the VOBC receives LMA instructions from the remote driver to traverse the switch. In some embodiments, the VOBC controls the guideway mounted vehicle to stop if the LMA instructions from the remote driver include traversing a portion of the guideway which includes a detected object.

One of ordinary skill in the art would recognize that an order of operations of method 300 is adjustable. One of ordinary skill in the art would also recognize that additional operations are includable in method 300, and that operations are able to be omitted form operation 300.

Figure 4:
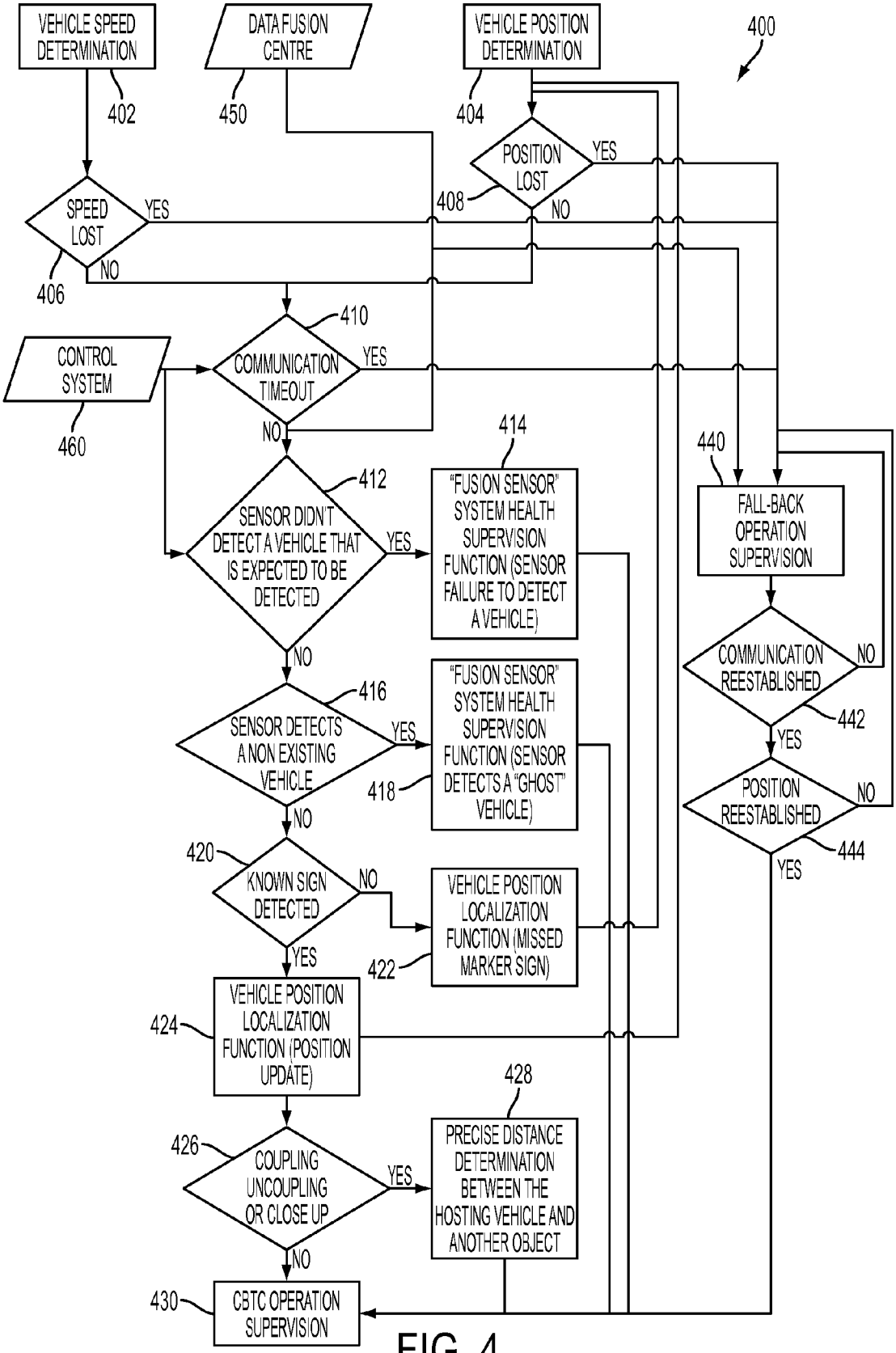
FIG. 4 is a functional flow chart for a method of determining a status of a fusion sensor arrangement in accordance with one or more embodiments.

FIG. 4 is a functional flow chart of a method 400 of determining a status of a fusion sensor arrangement in accordance with one or more embodiments. In some embodiments, method 400 is performed if operation 309 of method 300 (FIG. 3) is performed. In some embodiments, a VOBC causes method 400 to be executed periodically. In some embodiments, a data fusion center, e.g., data fusion center 130 (FIG. 1), causes method 400 to be executed upon determination of implausible data or upon receipt of conflicting data.

In operation 402, the VOBC determines a speed of the guideway mounted vehicle. In some embodiments, the VOBC determines the speed of the guideway based on information received from the centralized or de-centralized control system, information received from a data fusion center, e.g., data fusion center 130 (FIG. 1), measures taken from the guideway mounted vehicle (such as wheel revolutions per minute), or other suitable information sources. In some embodiments, the VOBC transmits the speed of the guideway mounted vehicle to the centralized or de-centralized control system.

In operation 404, the VOBC determines a position of the guideway mounted vehicle. In some embodiments, the VOBC determines the position of the guideway based on information received from the centralized or de-centralized control system, information received from a data fusion center, e.g., data fusion center 130 (FIG. 1), wayside transponders, or other suitable information sources. In some embodiments, the VOBC transmits the position of the guideway mounted vehicle to the centralized or de-centralized control system.

In operation 406, the VOBC determines whether the speed information is lost. In some embodiments, the speed information is lost due to failure of a communication system, failure of the data fusion center, an error within the VOBC or failure of another system.

In operation 408, the VOBC determines whether the position information is lost. In some embodiments, the speed information is lost due to failure of a communication system, failure of the data fusion center, an error within the VOBC or failure of another system.

If both of the speed information and the position information are still available, the VOBC determines if communication has timed out with the centralized or de-centralized control system, in operation 410. In some embodiments, the VOBC determines if communication has timed out by transmitting a test signal and determining whether a return signal is received. In some embodiments, the VOBC determines if communication has timed out base on an elapsed time since a last received communication. In some embodiments, the VOBC determines whether communication has timed out based whether an update to the guideway database was received from a control system 460.

If communication has not timed out, the VOBC determines whether a sensor of the fusion sensor arrangement did not detect a train that was expected to be detected in operation 412. The VOBC receives sensor information from data fusion center 450 and guideway database information from control system 460. Based on the guideway database information, the VOBC determines whether another guideway mounted vehicle is located at a position where the sensor of the fusion sensor arrangement should detect the other guideway mounted vehicle. Using the sensor information from data fusion center 450, the VOBC determines whether the other guideway mounted vehicle was detected. If a guideway mounted vehicle was available for detection and the sensor did not detect the guideway mounted vehicle, method 400 continues to operation 414.

In operation 414, the sensor of the fusion sensor arrangement is determined to be faulty. The VOBC provides instructions to data fusion center 450 to no longer rely on the faulty sensor. In some embodiments which include only two sensors in the fusion sensor arrangement, the VOBC ceases to rely on information provided by the fusion sensor arrangement. In some embodiments, the VOBC transmits a signal indicating a reason for determining the sensor as being faulty. In operation 414, the VOBC transmits a signal indicating the sensor failed to detect a guideway mounted vehicle, in some embodiments.

If no guideway mounted vehicle was available for detection or the sensor did detect a guideway mounted vehicle in operation 412, method 400 continues with operation 416. In operation 416, the VOBC determines whether the sensor detected a non-existing guideway mounted vehicle. Based on the guideway database information received from control system 460 and sensor information from data fusion center 450, the VOBC determines whether the sensor detected a guideway mounted vehicle where no guideway mounted vehicle is located. If a guideway mounted vehicle was detected, but the guideway dataset information indicates no guideway mounted vehicle was present, method 400 continues with operation 418.

In operation 418, the sensor of the fusion sensor arrangement is determined to be faulty. The VOBC provides instructions to data fusion center 450 to no longer rely on the faulty sensor. In some embodiments which include only two sensors in the fusion sensor arrangement, the VOBC ceases to rely on information provided by the fusion sensor arrangement. In some embodiments, the VOBC transmits a signal indicating a reason for determining the sensor as being faulty. In operation 418, the VOBC transmits a signal indicating the sensor detected a non-existent guideway mounted vehicle, in some embodiments.

If no guideway mounted vehicle was available for detection and the sensor did not detect a guideway mounted vehicle in operation 416, method 400 continues with operation 420. In operation 420, the VOBC determines whether the sensor detected a known wayside mounted object. Based on the guideway database information received from control system 460 and sensor information from data fusion center 450, the VOBC determines whether the sensor detected a wayside mounted object where a known wayside mounted object is located. If a known wayside mounted object was not detected, method 400 continues with operation 422.

In operation 422, the sensor of the fusion sensor arrangement is determined to be faulty. The VOBC provides instructions to data fusion center 450 to no longer rely on the faulty sensor. In some embodiments which include only two sensors in the fusion sensor arrangement, the VOBC ceases to rely on information provided by the fusion sensor arrangement. In some embodiments, the VOBC transmits a signal indicating a reason for determining the sensor as being faulty. In operation 422, the VOBC transmits a signal indicating the sensor failed to detect a known wayside mounted object, in some embodiments.

If the known wayside mounted object was detected in operation 420, method 400 continues with operation 424. In operation 424, the VOBC determines a location of the wayside mounted vehicle and transmits the determined location to control system 460 to update a location of the wayside mounted vehicle in the control system. In some embodiments, operation 424 is performed following operation 404. In some embodiments, operation 424 is performed every time a new location of the guideway mounted vehicle is determined.

In operation 426, the VOBC determines whether the guideway mounted vehicle is involved in a coupling/de-coupling process. The VOBC determines whether the guideway mounted vehicle is involved in the coupling/de-coupling process based on the sensor information from fusion data center 450 and the guideway database information from control system 460. The VOBC determines whether another guideway mounted vehicle is located within a coupling proximity to the guideway mounted vehicle. If the VOBC determines that the guideway mounted vehicle is involved in a coupling/de-coupling process, method 400 continues with operation 428.

In operation 428, the VOBC determine a precise distance between the guideway mounted vehicle and the other guideway mounted vehicle. The VOBC uses the sensor information and the guideway database information to determine the precise distance. In some embodiments, the VOBC sends instructions to data fusion center 450 to increase resolution of the sensor information. In some embodiments, the VOBC sends instructions to the acceleration and braking system to reduce the speed of the guideway mounted vehicle so that the location of the guideway mounted vehicle has a decreased rate of change. In some embodiment, the VOBC request more frequent update of the guideway database information from control system 460 to better determine a relative position of the other guideway mounted vehicle.

If the VOBC determines the guideway mounted vehicle is not involved in a coupling/de-coupling process, method 400 continues with operation 430. In operation 430, the VOBC continues to operate the guideway mounted vehicle in coordination with control system 460. In some embodiments, the VOBC uses the sensor information from data fusion center 450 in conjunction with information from control system 460. In some embodiments, the VOBC does not rely on the sensor information from data fusion center 450 in operation 430.

Returning to operations 406, 408 and 410, if the speed of the guideway mounted vehicle or the location of the guideway mounted vehicle is lost, or if communication with control system 460 has timed out, method 400 continues with operation 440. In operation 440, the VOBC relies on a fallback operation supervision to operate the guideway mounted vehicle. In some embodiments, the VOBC relies on sensor information from data fusion center 450 to operate the guideway mounted vehicle. In some embodiments, the VOBC performs in a manner similar to method 300 (FIG. 3) to operate the guideway mounted vehicle.

In operation 442, the VOBC determines whether communication with control system 460 is re-established. If communication with control system 460 is re-established, method 400 continues with operation 444. If communication with control system 460 is no re-established, method 400 returns to operation 440.

In operation 444, the VOBC determines whether the location of the guideway mounted vehicle is re-established. If the location of the guideway mounted vehicle is re-established, method 400 continues with operation 430. If the location of the guideway mounted vehicle is not re-established, method 400 returns to operation 440.

Figure 5:
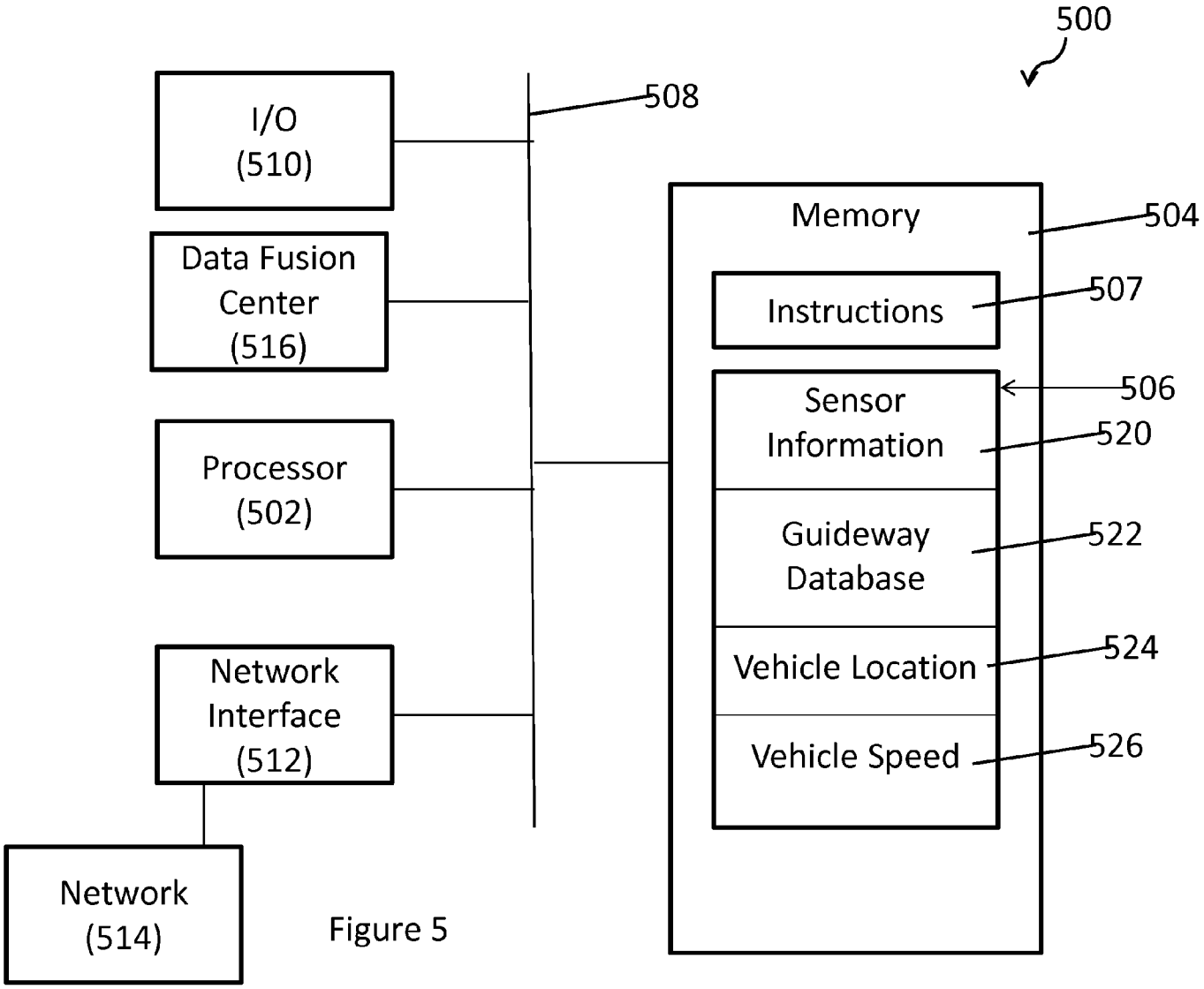
FIG. 5 is a block diagram of a vital on-board controller (VOBC) for using a fusion sensor arrangement in accordance with one or more embodiments.

FIG. 5 is a block diagram of a VOBC 500 for using a fusion sensor arrangement in accordance with one or more embodiments. VOBC 500 includes a hardware processor 502 and a non-transitory, computer readable storage medium 504 encoded with, i.e., storing, the computer program code 506, i.e., a set of executable instructions. Computer readable storage medium 504 is also encoded with instructions 507 for interfacing with manufacturing machines for producing the memory array. The processor 502 is electrically coupled to the computer readable storage medium 504 via a bus 508. The processor 502 is also electrically coupled to an I/O interface 510 by bus 508. A network interface 512 is also electrically connected to the processor 502 via bus 508. Network interface 512 is connected to a network 514, so that processor 502 and computer readable storage medium 504 are capable of connecting to external elements via network 514. VOBC 500 further includes data fusion center 516. The processor 502 is connected to data fusion center 516 via bus 508. The processor 502 is configured to execute the computer program code 506 encoded in the computer readable storage medium 504 in order to cause system 500 to be usable for performing a portion or all of the operations as described in method 300 or method 400.

In some embodiments, the processor 502 is a central processing unit (CPU), a multi-processor, a distributed processing system, an application specific integrated circuit (ASIC), and/or a suitable processing unit.

In some embodiments, the computer readable storage medium 504 is an electronic, magnetic, optical, electromagnetic, infrared, and/or a semiconductor system (or apparatus or device). For example, the computer readable storage medium 504 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 504 includes a compact disk-read only memory (CD-ROM), a compact disk-read/write (CD-R/W), and/or a digital video disc (DVD).

In some embodiments, the storage medium 504 stores the computer program code 506 configured to cause system 500 to perform method 300 or method 400. In some embodiments, the storage medium 504 also stores information needed for performing a method 300 or 400 as well as information generated during performing the method 300 or 400, such as a sensor information parameter 520, a guideway database parameter 522, a vehicle location parameter 524, a vehicle speed parameter 526 and/or a set of executable instructions to perform the operation of method 300 or 400.

In some embodiments, the storage medium 504 stores instructions 507 for interfacing with manufacturing machines. The instructions 507 enable processor 502 to generate manufacturing instructions readable by the manufacturing machines to effectively implement method 400 during a manufacturing process.

VOBC 500 includes I/O interface 510. I/O interface 510 is coupled to external circuitry. In some embodiments, I/O interface 510 includes a keyboard, keypad, mouse, trackball, trackpad, and/or cursor direction keys for communicating information and commands to processor 502.

VOBC 500 also includes network interface 512 coupled to the processor 502. Network interface 512 allows VOBC 500 to communicate with network 514, to which one or more other computer systems are connected. Network interface 512 includes wireless network interfaces such as BLUETOOTH, WIFI, WIMAX, GPRS, or WCDMA; or wired network interface such as ETHERNET, USB, or IEEE-1394. In some embodiments, method 300 or 400 is implemented in two or more VOBCs 500, and information such as memory type, memory array layout, I/O voltage, I/O pin location and charge pump are exchanged between different VOBCs 500 via network 514.

VOBC further includes data fusion center 516. Data fusion center 516 is similar to data fusion center 130 (FIG. 1). In the embodiment of VOBC 500, data fusion center 516 is integrated with VOBC 500. In some embodiments, the data fusion center is separate from VOBC 500 and connects to the VOBC through I/O interface 510 or network interface 512.

VOBC 500 is configured to receive sensor information related to a fusion sensor arrangement, e.g., fusion sensor arrangement 100 (FIG. 1), through data fusion center 516. The information is stored in computer readable medium 504 as sensor information parameter 520. VOBC 500 is configured to receive information related to the guideway database through I/O interface 510 or network interface 512. The information is stored in computer readable medium 504 as guideway database parameter 522. VOBC 500 is configured to receive information related to vehicle location through I/O interface 510, network interface 512 or data fusion center 516. The information is stored in computer readable medium 504 as vehicle location parameter 524. VOBC 500 is configured to receive information related to vehicle speed through I/O interface 510, network interface 512 or data fusion center 516. The information is stored in computer readable medium 504 as vehicle speed parameter 526.

During operation, processor 502 executes a set of instructions to determine the location and speed of the guideway mounted vehicle, which are used to update vehicle location parameter 524 and vehicle speed parameter 526. Processor 502 is further configured to receive LMA instructions and speed instructions from a centralized or de-centralized control system, e.g., control system 460. Processor 502 determines whether the received instructions are in conflict with the sensor information. Processor 502 is configured to generate instructions for controlling an acceleration and braking system of the guideway mounted vehicle to control travel along the guideway.

An aspect of this description relates to a fusion sensor arrangement including a first sensor configured to detect the presence of an object along a wayside of a guideway, wherein the first sensor is sensitive to a first electromagnetic spectrum. The fusion sensor arrangement further includes a second sensor configured to detect the presence of the object along the wayside of the guideway, wherein the second sensor is sensitive to a second electromagnetic spectrum different from the first electromagnetic spectrum. The fusion sensor arrangement further includes a data fusion center connected to the first sensor and to the second sensor, wherein the data fusion center is configured to receive first sensor information from the first sensor and second sensor information from the second sensor, and to resolve a conflict between the first sensor information and the second sensor information.

Another aspect of this description relates to a method of using the fusion sensor arrangement to control a guideway mounted vehicle. The method includes detecting an object on a wayside of a guideway using a first sensor, wherein the first sensor senses a first electromagnetic spectrum. The method further includes detecting the object on the wayside of the guideway using a second sensor, wherein the second sensor senses a second electromagnetic spectrum different from the first electromagnetic spectrum. The method further includes fusing first information from the first sensor with second information from the second sensor using a data fusion center. The method further includes resolving a conflict between the first information and the second information.

Still another aspect of this description relates to a guideway mounted vehicle including a first fusion sensor arrangement attached to a first end the guideway mounted vehicle. The first fusion sensor arrangement includes a first sensor configured to detect the presence of an object along a wayside of a guideway on which the guideway mounted vehicle is mounted, wherein the first sensor is sensitive to a first electromagnetic spectrum. The first fusion sensor arrangement includes a second sensor configured to detect the presence of the object along the wayside of the guideway, wherein the second sensor is sensitive to a second electromagnetic spectrum different from the first electromagnetic spectrum. The first fusion sensor arrangement further includes a data fusion center connected to the first sensor and to the second sensor, wherein the data fusion center is configured to receive first sensor information from the first sensor and second sensor information from the second sensor, and to resolve a conflict between the first sensor information and the second sensor information.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A fusion sensor arrangement comprising:

a first sensor configured to detect the presence of an object along a wayside of a guideway, wherein the first sensor is sensitive to a first electromagnetic spectrum;

a second sensor configured to detect the presence of the object along the wayside of the guideway, wherein the second sensor is sensitive to a second electromagnetic spectrum different from the first electromagnetic spectrum; and a data fusion center connected to the first sensor and to the second sensor, wherein the data fusion center is configured to receive first sensor information from the first sensor and second sensor information from the second sensor, and to resolve a conflict between the first sensor information and the second sensor information, wherein the data fusion center is configured to resolve the conflict based on a priority rule associated with a distance between the fusion sensor arrangement and the object, and a type of sensor of the first sensor and the second sensor, the first sensor is configured to determine the distance between the fusion sensor arrangement and the object for a distance less than a predetermined threshold value, and the second sensor is configured to determine the distance between the fusion sensor arrangement and the object for a distance greater than or equal to the predetermined threshold value.

2. The fusion sensor arrangement of claim 1, wherein the first sensor is further configured to detect the object along the guideway, and the second sensor is further configured to detect the object along the guideway.

3. The fusion sensor arrangement of claim 1, wherein the data fusion center is configured to determine whether at least one of the first sensor information or the second sensor information contains implausible information.

4. The fusion sensor arrangement of claim 1, wherein the data fusion center is further configured to resolve the conflict based on a priority between the first electromagnetic spectrum and the second electromagnetic spectrum.

5. The fusion sensor arrangement of claim 1, wherein the data fusion center is further configured to resolve the conflict based on the distance between the fusion sensor arrangement and the object.

6. The fusion sensor arrangement of claim 1, wherein the data fusion center is further configured to resolve the conflict based on a combination of the distance between the fusion sensor arrangement and the object and a priority between the first electromagnetic spectrum and the second electromagnetic spectrum.

7. The fusion sensor arrangement of claim 1, wherein the data fusion center is further configured to resolve the conflict based on a type of the object.

8. The fusion sensor arrangement of claim 1, wherein the first sensor is configured to collect identifying information from the object, and the second sensor is configured to collect identifying information from the object.

9. The fusion sensor arrangement of claim 1, wherein the data fusion center is configured to initiate a status check of at least one of the first sensor or the second sensor.

10. A method of using the fusion sensor arrangement to control a guideway mounted vehicle, the method comprising:

detecting an object on a wayside of a guideway using a first sensor, wherein the first sensor senses a first electromagnetic spectrum;

detecting the object on the wayside of the guideway using a second sensor, wherein the second sensor senses a second electromagnetic spectrum different from the first electromagnetic spectrum;

fusing first information from the first sensor with second information from the second sensor using a data fusion center; and resolving a conflict between the first information and the second information, based on a priority rule associated with a distance between the fusion sensor arrangement and the object, and a type of sensor of the first sensor and the second sensor, wherein the first sensor is configured to determine the distance between the fusion sensor arrangement and the object for a distance less than a predetermined threshold value, and the second sensor is configured to determine the distance between the fusion sensor arrangement and the object for a distance greater than or equal to the predetermined threshold value.

11. The method of claim 10, wherein detecting the object on the wayside using the first sensor comprises detecting an alphanumeric sign on the wayside, and detecting the object on the wayside using the second sensor comprises detecting the alphanumeric sign on the wayside.

12. The method of claim 10, wherein detecting the object on the wayside using the first sensor comprises detecting a barcode sign on the wayside, and detecting the object on the wayside using the second sensor comprises detecting the barcode sign on the wayside.

13. The method of claim 10, wherein resolving the conflict comprises selecting the first information or the second information based on a priority of the first electromagnetic spectrum and the second electromagnetic spectrum.

14. The method of claim 10, wherein resolving the conflict comprises selecting the first information or the second information based on the distance between the fusion sensor arrangement and the object.

15. The method of claim 10, wherein resolving the conflict comprises selecting the first information or the second information based on the distance between the fusion sensor arrangement and the object and a priority between the first electromagnetic spectrum and the second electromagnetic spectrum.

16. The method of claim 10, wherein resolving the conflict comprises selecting the first information or the second information based on a type of the object.

17. A guideway mounted vehicle comprising:

a first fusion sensor arrangement attached to a first end the guideway mounted vehicle, the first fusion sensor arrangement comprising:

a first sensor configured to detect the presence of an object along a wayside of a guideway on which the guideway mounted vehicle is mounted, wherein the first sensor is sensitive to a first electromagnetic spectrum;

a second sensor configured to detect the presence of the object along the wayside of the guideway, wherein the second sensor is sensitive to a second electromagnetic spectrum different from the first electromagnetic spectrum; and a data fusion center connected to the first sensor and to the second sensor, wherein the data fusion center is configured to receive first sensor information from the first sensor and second sensor information from the second sensor, and to resolve a conflict between the first sensor information and the second sensor information, wherein the data fusion center is configured to resolve the conflict based on a priority rule associated with a distance between the fusion sensor arrangement and the object, and a type of sensor of the first sensor and the second sensor, the first sensor is configured to determine the distance between the fusion sensor arrangement and the object for a distance less than a predetermined threshold value, and the second sensor is configured to determine the distance between the fusion sensor arrangement and the object for a distance greater than or equal to the predetermined threshold value.

18. The guideway mounted vehicle of claim 17, further comprising a second fusion sensor arrangement attached to the first end of the guideway mounted vehicle, wherein the second fusion sensor arrangement is spaced from the first fusion sensor arrangement, and the second fusion sensor arrangement comprises:

a third sensor configured to detect the presence of an object along a wayside of a guideway on which the guideway mounted vehicle is mounted, wherein the third sensor is sensitive to a third electromagnetic spectrum;

a fourth sensor configured to detect the presence of the object along the wayside of the guideway, wherein the fourth sensor is sensitive to a fourth electromagnetic spectrum; and a data fusion center connected to the third sensor and to the fourth sensor, wherein the data fusion center is configured to receive third sensor information from the third sensor and fourth sensor information from the fourth sensor, and to resolve a conflict between the third sensor information and the fourth sensor information.

19. The guideway mounted vehicle of claim 17, further comprising a second fusion sensor arrangement attached to a second end of the guideway mounted vehicle opposite from the first end, wherein the second fusion sensor arrangement comprises:

a third sensor configured to detect the presence of an object along a wayside of a guideway on which the guideway mounted vehicle is mounted, wherein the third sensor is sensitive to a third electromagnetic spectrum;

a fourth sensor configured to detect the presence of the object along the wayside of the guideway, wherein the fourth sensor is sensitive to a fourth electromagnetic spectrum; and a data fusion center connected to the third sensor and to the fourth sensor, wherein the data fusion center is configured to receive third sensor information from the third sensor and fourth sensor information from the fourth sensor, and to resolve a conflict between the third sensor information and the fourth sensor information.

20. The guideway mounted vehicle of claim 19, wherein at least one of the third electromagnetic spectrum or the fourth electromagnetic spectrum is different from at least one of the first electromagnetic spectrum or the second electromagnetic spectrum.

* * * * *